United States Patent [19]

Conkling

[11] 3,954,591

[45] May 4, 1976

[54] ICE FREE SELF-RELEASING WATER TANK ANODE SUSPENSION SYSTEM

[75] Inventor: William C. Conkling, Essex Fells, N.J.

[73] Assignee: Pennwalt Corporation, Philadelphia, Pa.

[22] Filed: Apr. 9, 1975

[21] Appl. No.: 566,477

[52] U.S. Cl. ..... 204/196; 204/147; 204/286; 204/297 R; 204/195 F

[51] Int. Cl.[2] ..... C23F 13/00

[58] Field of Search ..... 204/147, 148, 196, 197, 204/195 F

[56] References Cited

UNITED STATES PATENTS

| | | | |
|---|---|---|---|
| 2,656,314 | 10/1953 | Osterheld | 204/197 |
| 2,666,027 | 1/1954 | Vallett | 204/197 |
| 2,700,649 | 1/1955 | Hosford | 204/196 |
| 3,196,101 | 7/1965 | Hosford | 204/196 |
| 3,515,654 | 6/1970 | Bordalen et al. | 204/197 |
| 3,753,888 | 8/1973 | Alewitz | 204/197 |
| 3,855,102 | 12/1974 | Palmer | 204/196 |

*Primary Examiner*—T. Tung
*Attorney, Agent, or Firm*—Charles N. Quinn

[57] ABSTRACT

An apparatus is provided for use as a suspension device for suspending one or more anodes and one or more reference cells inside metallic water tanks as a portion of a cathodic protection system for the water tank for the inhibition of corrosion in the tank. The apparatus is particularly adapted for use in the northern reaches of the earth's temperate zones, where ice forms in outdoor water tanks during the winter season. The apparatus is designed to maintain the anodes and reference cells suspended therefrom in the liquid portion of the water tank as ice forms at the top of the water, the bottom of the water and at the sides of the tank and to allow the anodes and reference cells to retain the ability to perform their function despite the ice.

21 Claims, 8 Drawing Figures

ICE FREE SELF-RELEASING WATER TANK ANODE SUSPENSION SYSTEM

BACKGROUND OF THE INVENTION

1. Field of the Invention

The present invention is in the field of cathodic protection of metallic water tanks and more particularly in the field of suspension devices for suspending anodes and reference cells within said water tanks from the roof or other suitable structure which is located in the tank vertically above or at the top of the water in the tank. Specifically, the present invention relates to an apparatus for suspending the anodes and reference cells within the tank, in the water, providing resilient adjustment of the electrical lines and/or structural lines from which the anodes and reference cells are suspended so that the ice which forms in the tank does not adversely affect the anodes or reference cells by creating excessive downward forces thereon. The apparatus is most specifically designed to fit any standard water tank and may be installed in any said standard water tank. The apparatus is specifically adapted to be placed in any of a plurality of configurations within the water tank, depending on how large the water tank is and how many anodes are required therein for proper cathodic protection of the tank.

2. Description of the Prior Art

Water tanks used for municipal water supplies, industrial purposes and the like are subject to constant corrosion due to corrosive action from water contained in the tank, since such water tanks generally are constructed of steel. If such corrosion is not prevented, the tank will eventually wear away or be so weakened that the tank may structurally fail. This may result in the release of large amounts of water from extreme heights, with consequent danger to lives and property. Accordingly, it is desirable to protect such water tanks from the adverse effects of corrosion.

Water tanks are commonly protected both by various coatings which are applied to the inside of the water tank, such as epoxies and the like which prevent or reduce corrosive action and also are protected by various cathodic protection systems which produce a regulated, electrolytic effect to counteract the corrosive electrolysis which takes place at the water tank wall.

Cathodic protection apparatus is well developed and is in wide use at the present time. Such apparatus normally consists of one or more arrays of anodes placed in the water within the tank, apparatus to maintain the anodes positioned within the tank, electrical connecting apparatus connecting the anodes to a source of electrical current, a control mechanism for maintaining a constant voltage in the water in the tank and one or more reference cells with which to measure the voltage level within the water in the tank. A typical electrical system used to monitor the electrical voltage in the water within the water tank and to adjust the current input to the anode in response to the measured electrical voltage as the electrical conductivity of the water varies due to varying temperature, mineral content and the like, is shown in the U.S. Pat. No. issued to Maurin 3,516,917. Another typical electrical system for controlling the current input to the cathodic protection system in the water tank is shown in U.S. Pat. No. 3,425,921 issued to Sudrabin.

In the past in tanks which have experienced icing and have been equipped with cathodic protection devices, the anodes and other apparatus of the cathodic protection devices have typically been mounted in the bottom of the water tank, as shown in the cathodic protection device in the patent issued to Jacobs, U.S. Pat. No. 3,718,554. One disadvantage inherent in the cathodic protection devices which have been mounted on the bottom of the water tank is that such devices tend to become fouled with ice as the water in the tank, with the ice at its surface, drops below the level of the cathodic protection device. Then, while ice is still on the water and the water level in the tank rises, the ice may break or damage the cathodic protection device as the ice level rises past the level of the cathodic protector. Ice may also form along the sides and at the bottom of the tank. Ice at the tank bottom may entrap a tank-bottom-mounted electrolysis device while ice formed at the sides of the tank may encapsulate an anode suspended from the top of the tank where the anode has been disposed too closely to the side of the tank. Also, with the devices mounted on the bottom of the tanks, the current distribution within the water tends to be non-uniform and inefficient due to the confinement of the apparatus to a relatively narrow stratum of water at the bottom of the tank.

Spring suspended anodes hanging from the tops of the water tanks have long been known with one approach to a cathodic protection device suspended from the roof of the water tank being that shown in the U.S. Pat. No. issued to Palmer 3,855,102. The Palmer approach has definite disadvantages, one of which being that the apparatus shown therein, and others similar to it waste a certain volume of space at the top of the water tank because the water level cannot be permitted to rise to the level of the suspension means since ice might foul the spring suspension devices from which the anodes are suspended or might lock onto the electrical leads. If these devices are fouled and cannot function properly and if there is a large volume of ice, the weight of the ice pulling down on the suspension devices and the electrical lead wires as the water level in the tank drops may break the suspension devices and lead wires or may even break the top structure of the tank, to which the suspension devices are attached. Accordingly, it is required when the Palmer device or a similar spring suspension apparatus is used that a disproportionately large upper volume of the tank remain dormant, i.e., not be filled with water, so that the spring suspension devices do not become fouled with ice.

SUMMARY OF THE INVENTION

Heretofore it has not been known to construct a cathodic protection anode suspension device suspended from the top of a water tank which maximizes the amount of water which can be placed in the tank and which affords protection over a wide range of ice level changes. The present invention provides a suspension apparatus for water tank cathodic protection anodes and reference cells which overcome the aforementioned disadvantages and difficulties which are present in the prior art.

In accordance with the foregoing, it is a principal object of the present invention to provide a suspension apparatus for one or more anodes or a reference cell in a cathodic protection system for a water tank which, while suspended from the inside top of the tank, the anodes or reference cells will not be damaged or dislodged by ice action.

It is a further object of the present invention to provide a suspension apparatus for an anode in a cathodic protection system for a water tank which prevents damage to the roof of the tank due to the anodes being caught in ice in the water tank.

It is a further object of the present invention to provide a suspension apparatus for one or more anodes or a reference cell in a cathodic protection system which can be utilized as one of a plurality of suspension apparatus to suspend a plurality of anodes or reference cells about a water tank to protect a water tank by providing an optimum, even distribution of voltage throughout the tank.

It is a further object of the present invention to provide a suspension apparatus for one or more anodes or a reference cell in a cathodic protection system for a water tank which need not be removed during the winter season due to the formation of ice in the water tank.

It is a further object of the present invention to provide a suspension apparatus for one or more anodes or a reference cell in a cathodic protection system for a water tank which can function successfully in conjunction with a wide range of thicknesses of ice, any of which is present in the tank.

It is a further object of the present invention to provide a suspension apparatus for one or more anodes or a reference cell in a cathodic protection system for a water tank wherein at least a portion of said suspension means is electrically conductive thereby allowing electricity to be conducted to the suspended anodes or reference cells.

It is a further object of the present invention to provide a suspension apparatus for one or more anodes or a reference cell in a cathodic protection system for a water tank wherein such suspension apparatus incorporates a flexible means to compensate for changes in water level when ice is in the tank, thereby permitting one or more anodes or a reference cell suspended therefrom to remain within the water liquid portion while preventing damage to the roof of the tank or to the suspension means from which the anode is suspended.

It is a further object of the present invention to provide a suspension apparatus for one or more anodes or a reference cell in a cathodic protection system for a water tank wherein such suspension apparatus incorporates an extensible means to compensate for changes in water level when ice is in the tank thereby permitting an anode or a reference cell suspended therefrom to remain within the water while preventing damage to the roof of the tank or to the suspension means from which the anode is suspended.

It is a further object of the present invention to provide a suspension apparatus for one or more anodes or a reference cell in a cathodic protection system for a water tank wherein said suspension apparatus is protected from ice in the tank such that electricity can always be transmitted to the anodes and reference cell in the tank.

It is a further object of the present invention to provide a suspension apparatus for one or more anodes or a reference cell in a cathodic protection system for a water tank wherein an extensible means is so disposed such that water cannot penetrate into the interior portion of said extensible means, where the extensible means comprises an extensible portion of the suspension apparatus.

It is a further object of the present invention to provide a suspension apparatus for one or more anodes or a reference cell in a cathodic protection system for a water tank wherein an extensible means need not be above the water level of the tank in order to allow the anodes or reference cell to be pulled downwardly within the water tank without damage occurring to the roof of the water tank or to the suspension apparatus.

It is a further object of the present invention to provide a suspension apparatus for one or more anodes or a reference cell in a cathodic protection system for a water tank wherein an extensible means is utilized as a part of said suspension apparatus such that when extended, while surrounded by ice, the action of said extensible means will selfrelease the suspension apparatus from the ice.

It is a further object of the present invention to provide a suspension apparatus for one or more anodes or a reference cell in a cathodic protection system for a water tank wherein a flexible means is utilized as a part of said suspension apparatus such that when flexed, while surrounded by ice, said flexible means will selfrelease the suspension apparatus from the ice.

It is a further object of the present invention to provide a suspension apparatus for one or more anodes or a reference cell in a cathodic protection system for a water tank whereby short-circuiting of the system with consequent loss of electrolytic action will not occur if a bottom anode or a bottom reference cell contacts the bottom of the water tank.

These and other objects of the present invention will be apparent to those of ordinary skill in the art from an inspection of the attached drawing figures and from a reading of the following specification and the appended claims.

The present invention in the preferred embodiment solves the problems present in the prior art by providing a generally closed suspension system comprised essentially of a flexible coil spring which serves as an electrical conductor, surrounded by a sealed elastomeric tube-like device, where attached to each end of the elastomeric device are electrical conductors connected to the ends of the spring and attachment means for attaching the elastomeric enclosed spring to the top of the water tank and to the anodes or reference cell suspended underneath the elastomeric enclosed spring.

DESCRIPTION OF THE PREFERRED EMBODIMENTS

Figure 1:
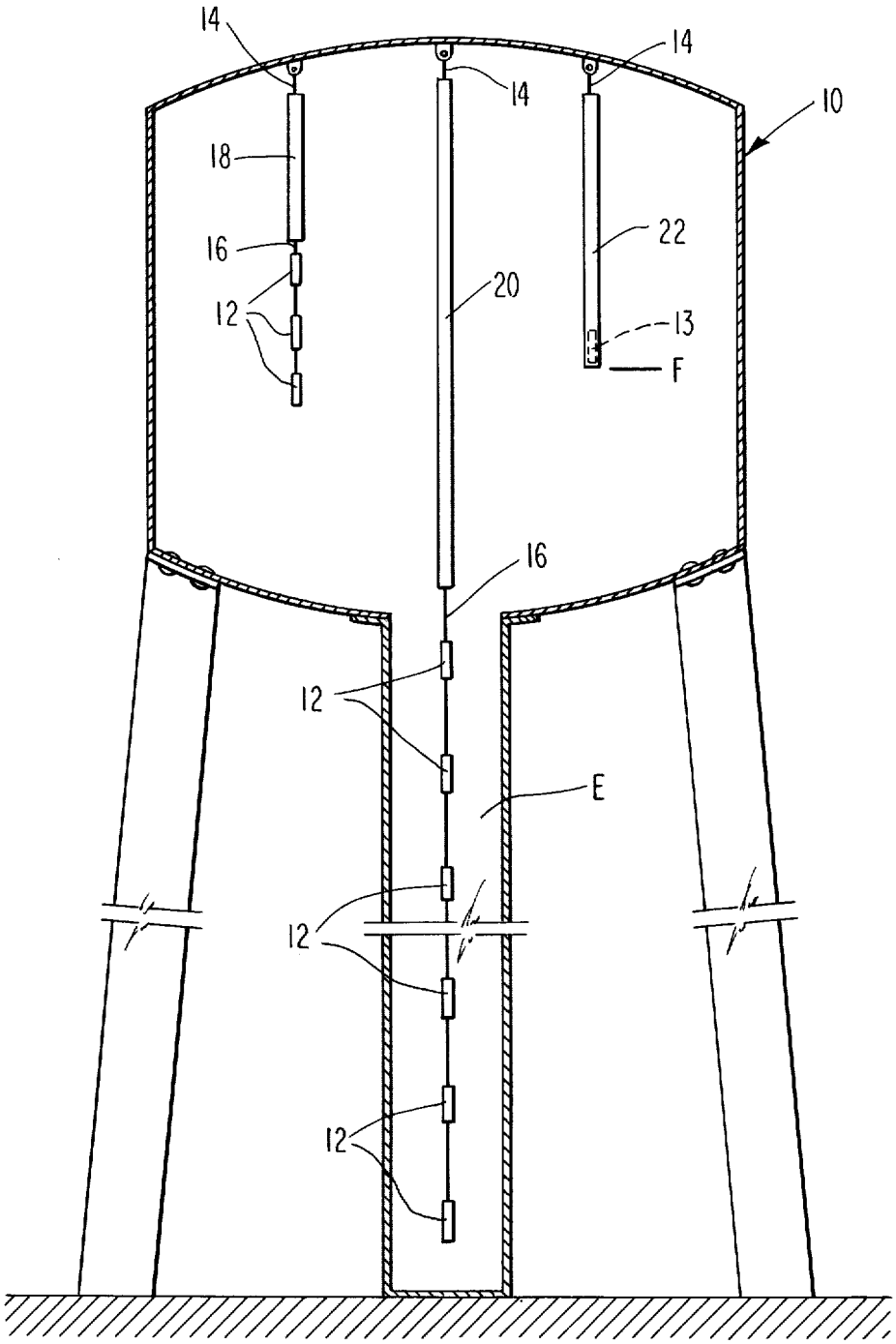
FIG. 1 is a side sectional view of a conventional water tank with a cathodic protection system installed therein where the suspension apparatus of the present invention, a reference cell and several anodes are shown schematically.

FIG. 1 illustrates a typical steel water tank, designated generally as 10, with a cathodic protection system installed therein. The cathodic protection system has been shown only schematically as a series of conventional anodes 12 suspended from two different embodiments of the suspension apparatus of the present invention, 18 and 20, which are in turn suspended by suspension means 14 such as electrically conductive cables from conventional clamps or other attachment apparatus located at the top of the water tank. The anode strings comprised of the anodes 12 are suspended from the suspension apparatus by an insulated electrically conductive cable 16. A third embodiment of the suspension apparatus of the present invention, designated generally as 22, has suspended therefrom a reference cell designated generally as 13.

It will be understood that the configuration of the cathodic protection system shown in FIG. 1 is illustrated only as a typical protection system and in no way limits the application of the suspension apparatus of the present invention to a cathodic protection system having a configuration of that shown in FIG. 1, nor does it limit the application of the suspension apparatus of the present invention to water tanks of the configuration shown in FIG. 1. Indeed, it is to be understood that the suspension apparatus of the present invention is applicable and appropriate for use in any cathodic protection system in any type of water tank where one or more anodes and/or one or more reference cells must be suspended within the tank. Such tanks include elevated tanks, reservoir tanks, stand-pipes and water spheres. Furthermore, the suspension apparatus of the present invention is applicable for use with any type of system for controlling voltage and current in the water tank which is protected by the cathodic protection system.

Figure 4:
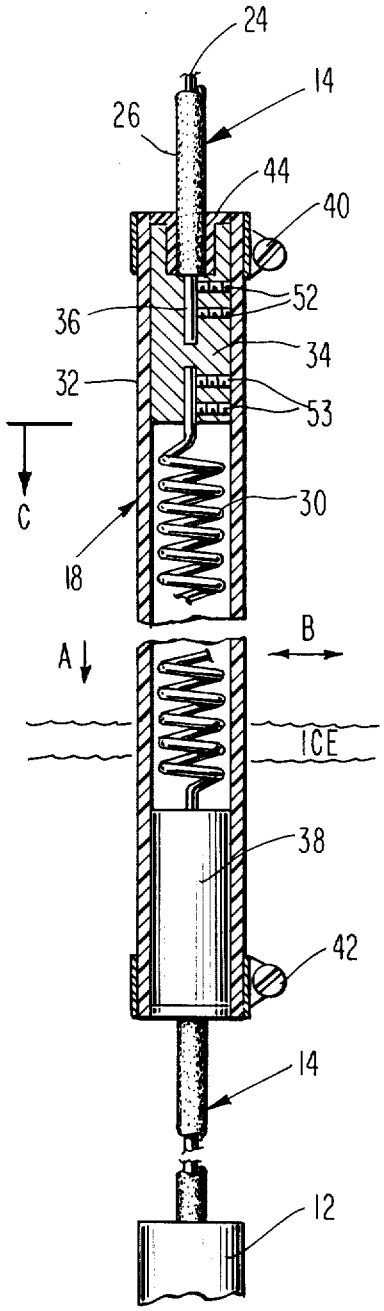
FIG. 4 is a broken, sectional view of the preferred embodiment of the suspension apparatus of the present invention.

Reference is now made to FIG. 4 wherein the preferred embodiment of the suspension means apparatus, for suspending one or more anodes or a reference cell, of the present invention is shown in more detail. The suspension means apparatus is suspended by first means 14 for suspending said suspension means apparatus from the inside roof of a water tank. It is to be understood that the first means 14 can be of a type shown in FIG. 1 wherein an electrically conductive wire 24, protected by electrical insulation 26, is inserted into a receptical end means 36 in a first end fitting means 34 which is a part of the suspension means apparatus 18. However, it is to be understood that the suspension means apparatus can be connected to the first means 14 for suspending said suspension means apparatus in any of a variety of ways which are well known in the mechanical arts. It is further to be understood that the first means for suspending the suspension means apparatus need not also carry electricity, but can be merely a structural suspension, with an auxiliary wire carrying electricity to the suspension means apparatus or to the anodes suspended therefrom.

The first end fitting apparatus 34 is equipped with a compression screw means 52 of the set-screw type which is used to secure the electrically conductive wire 24 within the end fitting means 34 to insure electrically connecting contact between the end fitting means 34 and the conducting wire 24. A sealing means 44 is used at the juncture end of the suspension means apparatus 18 for sealing the first end fitting means 34 within a flexible protection means 32. Located at an opposite end of the flexible protection means 32 is a second end fitting means 38 which is substantially similar to the first end fitting means 34. Clamp means 40 and 42 are shown securing the flexible protection means 32 about the two end fitting means 34 and 38. It is to be understood that the flexible protection means 32 is a water-tight material and that in combination, the clamp means 40 and 42, the sealing means 44 and the flexible protection means 32 provide a water-tight compartment for repose therein of the extensible means 30. The extensible means 30 is secured to the two end fitting means 34 and 38 and provides for extension of the suspension means apparatus 18 when a downward force is applied to an anode 12 suspended from the suspension means. Although the extendable or extensible means has been shown secured to the end fitting means via compression screw means 53, it is to be understood that the extensible means can be secured to the end fitting means by any suitable means many of which are well known in the mechanical arts.

The structure at the lower end of the suspension means apparatus is substantially the same as that shown at the upper end, including the clamp, the end fitting means, the compression screw means, the sealing means and the like and accordingly detailed discussion of such structure is not deemed to be warranted.

It is to be understood that any suitable extensible means 30 which is an electrical conductor can be used in the preferred embodiment of the present invention. In practice, the use of a steel coil spring of the type shown generally in FIG. 4 has proven to be quite successful. Many other types of extensible devices including coil springs of materials other than steel which are electrical conductors could also be used. It is to be understood that the flexible protection means 32 is preferably made of an elastomeric material which can stretch in the vertical direction designated by A in FIG. 4 as a downward force is applied to the anode 12, as the extensible means 30 extends in response thereto, or as a downward force is applied to the suspension means apparatus itself due to ice surrounding and holding the suspension means apparatus as the water level in the tank is lowered. Such stretching of the flexible protection means is the property, in combination with the spring-like property of the extensible means, which provides for self-release of the suspension means apparatus of the present invention when the suspension means apparatus of the present invention is surrounded by ice.

To illustrate the operation of the present invention, a layer of ice has been schematically shown surrounding the suspension means apparatus in FIG. 4. As the water level and the ice layer move downward, there is a downward force exerted by the ice on the suspension means due to adhesion of the ice to the flexible means. The extensible means 30 and the flexible protection means 32 then extend in the direction shown by the arrow associated with letter A. This results in a reduction in the diameter of the flexible protection means, in a direction shown by the arrows associated with letter B. Due to such tensioning and resultant reduction in diameter, the cross-sectional area of the suspension means apparatus is reduced, and the apparatus is no longer held securely by the ice layer. Accordingly, any substantial downward force on the suspension apparatus caused as a result of the ice moving downwardly as it is adhering to the suspension apparatus causes the ice to release from the suspension apparatus.

Although the hardware fittings for the suspension means apparatus of FIG. 4, which is the preferred embodiment of the present invention, have been described in substantial detail, it is to be understood that any suitable hardware apparatus for securing the end fitting, the flexible means, and the conductive means, which serves to transmit electricity to the anode, may be used so long as the extensible means is aquatically insulated, by the surrounding structure and the associated water-tight seals, from any water and ice within the tank. It is this aquatic insulation of the extensible means in the embodiment of FIG. 4 whereby ice cannot foul the extensible means when a coil spring is used as an extensible means, that provides for the self-release of the suspension means apparatus from ice when ice is formed within the tank. Were the flexible and extendable properties of the flexible means not present in the invention, as the water level in the tank lowered when ice had fouled the coil spring means, tremendous downward force at the top of the water tank would be produced, with consequent danger of collapse of the tank, or deformation or rupture of the suspension means. It is precisely these problems that the present invention successfully prevents.

Figure 3:
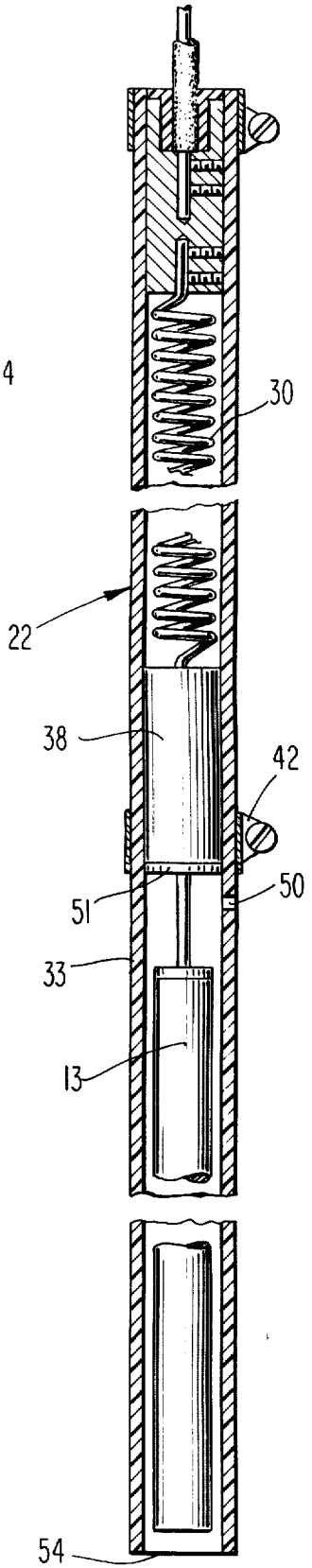
FIG. 3 is a broken, sectional view of another embodiment of the suspension apparatus of the present invention showing a reference cell in place within the suspension apparatus.

Another embodiment of the present invention is illustrated in FIG. 3, where the flexible protection means 33 has been extended well beyond the end fitting means 38, which was the extremity of the suspension means apparatus in the preferred embodiment, to provide a protective housing for a reference cell 13 which is used by any of a variety of electrical control systems to monitor and thereby control the electrical current and voltage within the water tank. Specifically, in the embodiment illustrated in FIG. 3, an air hole 50 is provided in the flexible protection means 33 and the bottom of the flexible protection means 33 is open to allow water to enter therein so the reference cell can sense the amount of current and voltage potential present in the water in the water tank. Accordingly, it is to be understood that the water-tight seal characteristics which serve to aquatically insulate the extensible means 30, in the embodiment illustrated in FIG. 3, are present at the second end fitting means 38, not at the bottom end of the flexible protection means which has been designated as 54. Indeed, water must be allowed around the reference cell so that the cell can adequately sense the voltage potential within the water in the water tank. An insulating disc 51 is provided so as to prevent the water in the flexible protection means 33 from contacting the connecting means 38. In all respects other than the configuration of the flexible protective means 33, the suspension means apparatus illustrated in FIG. 3 is substantially the same as that illustrated in FIG. 4.

Figure 2:
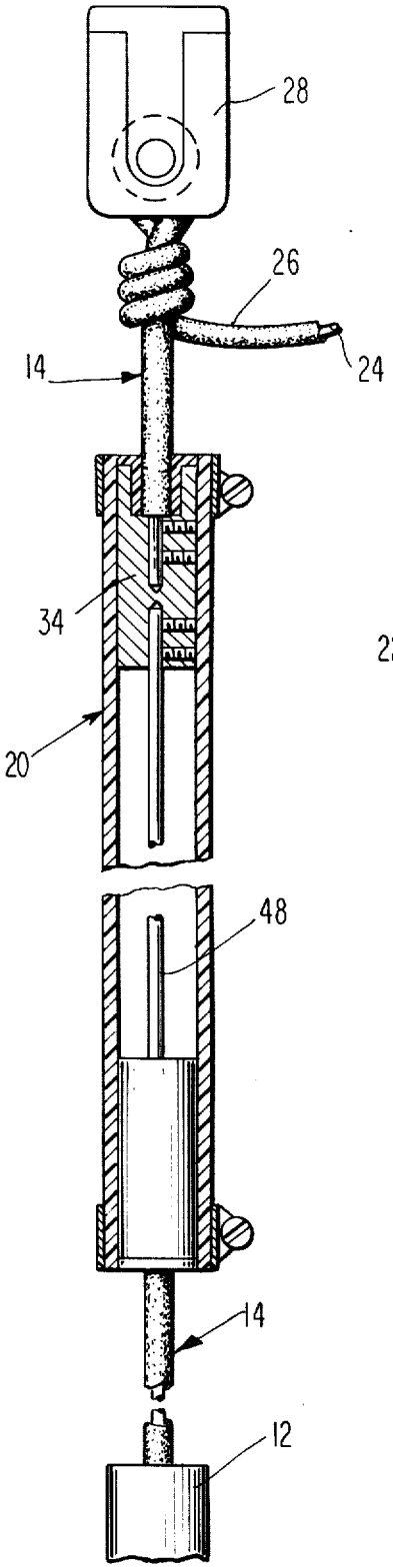
FIG. 2 is a broken, sectional veiw of one embodiment of the suspension apparatus of the present invention shown in a typical configuration as it would be used in a cathodic protection system suspended from a suspension structure and having one anode suspended from the suspension apparatus.

FIG. 2 illustrates yet another embodiment of the suspension apparatus of the present invention. In FIG. 2 the suspension apparatus is shown suspended via an insulated electrically conductive wire designated generally as 14, where the insulation is shown as 26 and the electrically conducting wire is shown as 24, which has been secured to a conventional hook or other support apparatus 28 which in turn is secured to the top of the water tank or to other suitable structure within the water tank. In the embodiment of the suspension means apparatus illustrated in FIG. 2, no extensible means, such as the coil spring means shown as 30 in FIG. 4, is present. Rather, a structural connecting means connecting the first end fitting means 34 with the second end fitting means 38 is shown. This is because the embodiment of the present invention illustrated in FIG. 2 is utilized for the suspension of anodes or reference cells in situations where the anodes or reference cell will always be in the water below the lowest level ice can attain at the water surface, and consequently the anodes or reference cell will not move up and down nor will forces be placed on the suspension means due to a lack of vertical movement of the anodes or reference cell. In this embodiment, typically a structural steel wire such as shown as 48 can be used as the connecting means between the two end fitting means 34 and 38. In all other respects, this embodiment of the present invention is substantially similar to that shown in FIG. 4, and retains the ice self-release characteristics present in the preferred embodiment.

Figure 5:
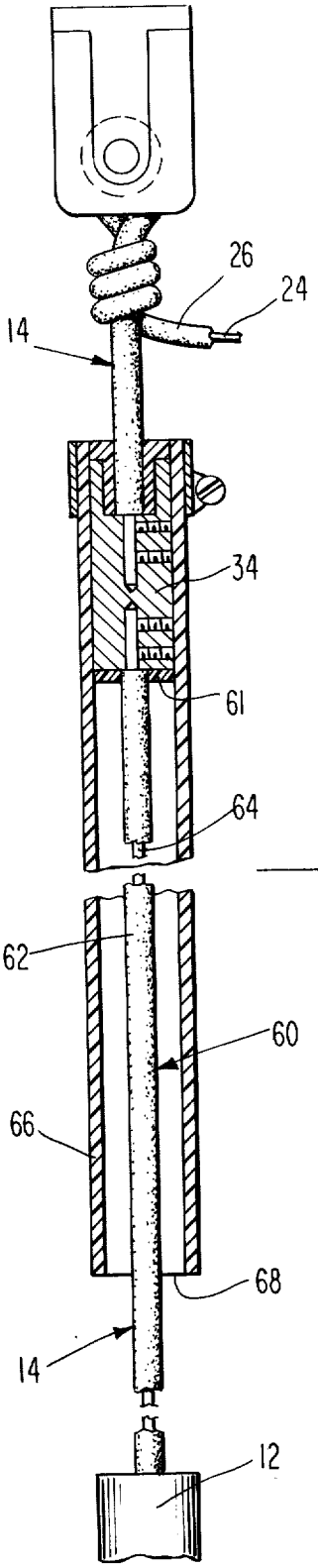
FIG. 5 is a broken, sectional view of a fourth embodiment of the suspension apparatus of the present invention.

FIG. 5 illustrates yet another embodiment of the suspension apparatus of the present invention. In FIG. 5, the suspension apparatus is again shown suspended via an insulated electrically conductive wire designated generally as 14, when the insulation is shown as 26 and the electrically conducting wire is shown as 24, which has been secured to a conventional hook or other support apparatus 28 which in turn is secured to the top of the water tank or to other suitable structure within the water tank. In the embodiment of the suspension means apparatus illustrated in FIG. 5, no extensible means, such as the coil spring means shown as 30 in FIG. 4, is present. Rather, the anode 12, or reference cell, is suspended directly from the first connecting means 34 via an insulated connecting wire 60 having insulation 62 surrounding the electrically connecting wire means 64. The flexible means 66 extends downward from the first connecting means 34 in much the same manner as does the flexible means 32 extend down past the second connecting means 38 in the embodiment shown in FIG. 3. However, in the embodiment shown in FIG. 5, the end 68 of the flexible means is open, thereby allowing the water to contact the insulated connecting wire 60. An insulating disc 61 is provided, similar to element 51 in the embodiment shown in FIG. 3 to prevent water in the flexible means 66 from contacting the first end fitting means 34. It is to be understood that the suspension apparatus when constructed in the embodiment shown in FIG. 5 would be constructed with the flexible means 66 sufficiently long so that as the water level in the tank varied, the surface of the water in the tank, and hence any ice thereon, would always be located somewhere along the length of the flexible means 66.

Figure 6:
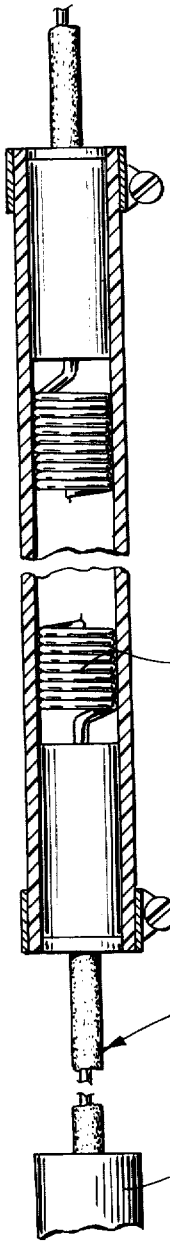
FIG. 6 is a broken, sectional view of another embodiment of the suspension apparatus of the present invention showing the spring within the suspension apparatus as being in compression when no load has been applied to the suspension apparatus.
Figure 7:
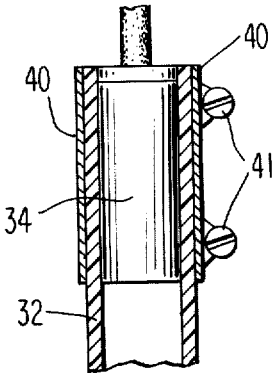
FIG. 7 is a broken, sectional view of another embodiment of the end structure of the suspension apparatus of the present invention with a slightly different arrangement of the end structure hardware of the suspension apparatus.

FIG. 7 illustrates still another embodiment of the suspension apparatus of the present invention. The embodiment shown in FIG. 7 has an end fitting means 34 and a flexible protection means 32 substantially similar to those of the other embodiments which have been illustrated and described. However, in the embodiment shown in FIG. 7, the clamp means 40 has been provided with two clamping screws 41 and has had the clamp means extended so that it extends substantially the same length along the suspension means as the end fitting means 34. This permits the clamp means to exert force on the flexible protection means 32, pressing the flexible protection means against the end fitting means 34 over substantially the entire area at which these two structures are in contact, thereby providing even more assurance of water-tight seal between elements 32 and 34. In all other respects, the structure of the embodiment of the present invention shown in FIG. 7 is substantially the same as that in the end fitting means areas of the embodiments shown in FIGS. 2, 4 and 6.

Figure 8:
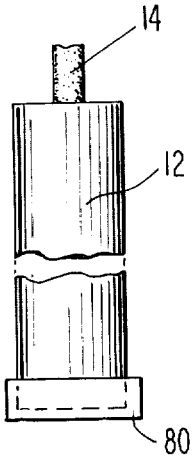
FIG. 8 is a partial, broken view of a bottom anode which might be suspended from the suspension apparatus of the present invention showing an insulating end cap on the bottom of the anode.

FIG. 8 illustrates a bottom anode, which may be suspended by itself or as the bottom anode on a string of anodes, with an insulating cap 80 in place over the anode 12. The use of such an insulating cap on the bottom anode suspended in a string is desirable because, should ice pull the anode string downward so that the bottom anode contacts the bottom of the water tank, the insulating cap will prevent a short circuit between the anode and the tank which would result in the loss of the desired electrolytic effect. The insulating cap 80 can be made of any electrically insulating material which does not degrade after being submerged in water for extended periods, such as polyethylene or polypropylene. The insulating cap can be attached to the anode in any suitable manner, such as by using epoxy cement. Naturally, the use of penetrating metallic screws through the insulating cap would not be suitable, unless the heads of the screws were covered with head caps of an insulating material, because short circuiting could occur should the screw heads contact the water tank. Any suitable configuration of the insulating cap may be used and it is to be specifically understood that the configuration shown in FIG. 8 is included to be illustrative and not limiting.

FIG. 6 illustrates another embodiment of the suspension apparatus of the present invention which is substantially similar to that illustrated in FIG. 4, except that the coil spring means shown as 90 in FIG. 4 has been shown to be in tension. In this connection it is to be understood that those embodiments of the present invention having springs therein may be constructed so that, before the suspension devices have been installed and had a load such as some anodes or a reference cell, suspended therefrom, the spring may be in compression, in tension or completely at rest. All three such conditions are within the contemplation of the present invention and FIGS. 4 and 6 have been included with different spring configurations to emphasize this fact. Other than the configuration of the spring, the apparatus shown in FIG. 6 is substantially the same as that shown in FIG. 4.

It is to be understood that the length in which the suspension means apparatus is constructed in any embodiment of the present invention will depend on the amount by which it is anticipated the water level in the water tank will vary during the winter season. Specifically, it is desirable to have the water level, with respect to the suspension means apparatus, be at or below the level designated by the letter C in FIG. 4 so tht ice at the surface of the water is always at or below the area of the suspension means apparatus which can be flexed and compressed. This will guarantee that the suspension means apparatus will always be free of any ice surrounding it.

Typically, the suspension means apparatus of the present invention, when installed in a water tank, might be constructed with relative lengths such as are shown in FIG. 1. In the installation illustrated in FIG. 1, the suspension means apparatus 20 of the embodiment illustrated in FIG. 2 has been constructed in a quite lengthy embodiment since it is anticipated that the water column, designated generally by the letter E, will always be filled with water and consequently surface ice will not lock onto the anode array contained therein. Thus there is no need for extendability in the anode suspension apparatus, there is only the need for releasability from the ice. However, the water level in the main tank may be subject to considerable fluctuation during the winter season and therefore, extendability in the suspension means apparatus 18 and 22 is desirable. Since it is desirable always to have the reference cell within the water, the installation illustrated in FIG. 1 would be designed for a situation where the water level in the tank would never go below the level designated by F. Again, it is to be emphasized that the configuration shown in FIG. 1 is merely illustrative and in no way limits the application of the suspension means apparatus of the present invention.

In addition to the releasability feature of the present invention when ice at the surface of the water has formed about the suspension apparatus, the apparatus of the present invention also acts to successfully prevent damage to the water tank and to the anodes and reference cell of the cathodic protection system when ice forms about the anodes and then moves up and down due to changes in the level of the surface of the water. If ice has formed about an anode and the water level then moves down, if the embodiments of the suspension apparatus shown in FIGS. 4 and 6 are used, the extendible means of the anode suspension apparatus extends, thereby protecting the suspension apparatus and the roof from damage. In an application requiring design extremes, the suspension apparatus can be so proportioned so that it can stretch to the bottom of the tank and thus allow the anode caught in the ice to travel to the extreme of the vertical travel of the water surface. Likewise, when the water level rises and the ice-encased anode moves up, the flexibility of the suspension apparatus protects the suspension apparatus from being jammed into the top of the water tank thereby preventing damage to the suspension apparatus and to the top of the tank. This flexibility characteristic also acts to prevent damage upon a rise in the water level, its floating ice layer and an entrapped anode, when the embodiment of the suspension apparatus illustrated in FIG. 5 is used.

It has been found that the suspension means apparatus of the present invention operates very well over a temperature range of from −40° F to 150° F in water tanks of many different sizes. It also works well in stand-pipes with a maximum height of 100 feet or more.

The sealing means 44 has used polyethylene as a material very successfully. However, any suitable sealing plastic-type material can be used for the sealing means. Likewise, the flexible protection means has been made of an elastomeric material such as soft gum rubber. However, any of a variety of materials can be used for the flexible protection means. It is to be emphasized that the materials used for the end fitting means and the extensible or connecting means should ideally be electrically conductive materials so as to assure that electricity can be conducted from the wire 24 to one or more suspended anodes or to a reference cell and auxiliary electrical connection cables will not be required. It is most desirable that the materials surrounding the suspension means apparatus be electrically insulating materials so that all electricity which is dispersed into the system is dispersed by the anodes, rather than by the suspension means apparatus. Accordingly, the flexible protection means 32 and the end sealing means 44, 51 and 61 should be electrical insulators similar in insulating property to the wire insulation 24. Additionally, these materials must be waterproof so as to achieve the aquatic isolation of the extensible means discussed above.

What is claimed is:

1. In combination with a cathodic protection system for protecting a metallic water tank subject to subfreezing environmental temperatures from corrosion, wherein at least one anode is provided for protecting said tank from corrosion, the improvement which comprises suspension means apparatus suspending either said anode or a reference cell from the inside roof of the water tank, said suspension means apparatus comprising:

a. first means suspending said suspension means apparatus downward from a suitable structure inside said water tank;

b. second means suspending said at least one anode or said reference cell downward from said suspension means apparatus;

c. extensible means connected between said first and second means, for extending in response to a downward force;

d. flexible protection means aquatically insulating in a watertight compartment said extensible means from water and any ice within said water tank disposed around said extensible means for extension therewith;

wherein said flexible protection means and said extensible means of said suspension means apparatus will extend downwardly together in response to a downward force exerted on an anode or reference cell or on a portion of said flexible protection means by ice attachedly forming thereto and wherein said suspension means apparatus will self-release from any ice layer which forms about said watertight compartment of said flexible protection means upon a change in the level of water supporting said ice layer by said flexible protection means elongating initially in response to vertical movement of said ice layer, said elongation resulting in a reduction in diameter of said flexible protection means thereby resulting in said diameter of said flexible protection means being less than the diameter of the hole in the ice which resulted when ice formed about said watertight compartment of said flexible protection means, resulting in separation of said suspension means from said ice layer.

2. In combination with a cathodic protection system for protecting a metallic water tank from corrosion, wherein at least one anode is provided for protecting said water tank from corrosion, the improvement of claim 1 wherein said suspension means apparatus further comprises:

a. first end fitting means in engaged relation within said flexible protection means at an upper end thereof, having a first receptical end receiving said first means suspending said suspension means apparatus, and having a second receptical end receiving a first end of said extensible means;

b. second end fitting means in engaged relation within said flexible protection means at a lower end thereof having a first receptical end receiving said second means suspending said at least one anode or said reference cell from said suspension means apparatus and having a second receptical end receiving a second end of said extensible means;

c. first clamp means clamping a first end of said flexible protection means around said first end fitting means thereby affecting a substantially watertight seal therebetween;

d. second clamp means clamping a second end of said flexible protection means around said second end fitting means thereby affecting a substantially watertight seal therebetween;

e. first sealing means affecting a substantially watertight seal at the juncture of said first means suspending said suspension means apparatus from the inside roof of said water tank and said first end fitting means;

f. second sealing means affecting a substantially watertight seal at the juncture of said second means suspending at least one anode or a reference cell from said suspension means apparatus and said second end fitting means;

g. first compression screw means in threaded engagement with said first end fitting means securing said first end fitting means and said extensible means; and h. second compression screw means in threaded engagement with said second end fitting means securing said second end fitting means and said extensible means.

3. In combination with a cathodic protection system for protecting a metallic water tank from corrosion, wherein at least one anode is provided for protecting said water tank from corrosion, the improvement of claim 1 wherein said extensible means comprises:

a. coil spring means extending upon the exertion of a tensile force thereon due to a lowering of water level in the water tank;

and wherein said flexible protection means comprises:

b. an elastomeric tubing having a cross-sectional disposition of the general form of two concentric circles and being of generally hollow cylindrical form.

4. In combination with a cathodic protection system for protecting a metallic water tank from corrosion, wherein at least one anode is provided for protecting said water tank from corrosion, the improvement of claim 3 wherein said first end fitting means, said coil spring means, said second end fitting means, said first means suspending said suspension means apparatus and said second means suspending said at least one anode or said reference cell from said suspension means apparatus are all in electrically connected disposition and wherein said flexible protection means and said first and second sealing means are electrical insulators.

5. In combination with a cathodic protection system for protecting a metallic water tank from corrosion, wherein at least one anode is provided for protecting said water tank from corrosion, the improvement of claim 1 wherein said suspension means apparatus further comprises:

a. first end fitting means in engaged relation within said flexible protection means, at an upper end thereof, having a first receptical end receiving said first means suspending said suspension means apparatus, and having a second receptical end receiving a first end of said extensible means;

b. second end fitting means in engaged relation within said flexible protection means remote from a lower end thereof, having a first receptical end receiving said second means suspending said at least one anode or said reference cell from said suspension means apparatus, and having a second receptical end receiving a second end of said extensible means;

c. first clamp means clamping a first end of said flexible protection means around said first end fitting means thereby affecting a substantially watertight seal therebetween;

d. second clamp means clamping a portion of said flexible protection means around said second end fitting means thereby affecting a substantially watertight seal therebetween;

e. first sealing means affecting a substantially watertight seal at the juncture of said first means suspending said suspension means apparatus from the inside roof of said water tank and said first end fitting means;

f. second sealing means affecting a substantially watertight seal at the juncture of said second means suspending at least one anode or a reference cell and said second end fitting means;

g. first compression screw means in threaded engagement with said first end fitting means securing said first end fitting means and said extensible means;

h. second compression screw means in threaded engagement with said second end fitting means securing said second end fitting means and said extensible means;

i. hole means through the wall of said flexible protection means, at a position vertically lower than the location of said second clamp means and said second end fitting means; wherein said flexible protection means extends below said second end fitting means and below said second clamp means a distance in excess of the length of said reference cell, and wherein said flexible protection means has an inside cross-sectional area larger than said reference cell.

6. The improved combination of claim 1 wherein said first means suspending said suspension means apparatus is of only such length that said first end fitting means is above the maximum high water level in the tank when said improved combination is installed in the water tank.

7. The improvement of claim 1 wherein said extensible means comprises:

a. coil spring means for extending upon the exertion of a tensile force thereon due to a lowering of water level in the water tank;

and wherein said flexible protection means comprises:

b. an elastomeric tubing having a cross-sectional disposition of the general form of two concentric circles and being of generally hollow cylindrical form.

8. The improvement of claim 7 wherein said flexible protection means and said extensible means are each disposed to extend downwardly in response to a downward force exerted on said at least one anode or said reference cell a sufficient length such that said at least one anode or said reference cell can reach the minimum low level of water in the watertank.

9. The improvement of claim 1 wherein said first means suspending said suspension means apparatus is of only such length that when the suspension means apparatus is installed in a water tank, at least a portion of said watertight compartment is above the maximum high level of water in the water tank.

10. In combination with a cathodic protection system for protecting a metal water tank subject to subfreezing environmental temperatures from corrosion, wherein at least one anode is provided for protecting said tank from corrosion, the improvement which comprises suspension means apparatus suspending either said at least one anode or a reference cell from the inside roof of the water tank, said suspension means apparatus comprising:

a. first means suspending said suspension means apparatus downward from a suitable structure inside said water tank;

b. second means suspending said at least one anode or said reference cell downward from said suspension means apparatus;

c. connecting means for structurally connecting said first and second means; and d. flexible protection means aquatically insulating in a watertight compartment said connecting means from water and any ice within said water tank disposed around said connecting means;

wherein said suspension means will self release from any ice layer which forms about said watertight compartment of said flexible protection means upon a change in the level of water supporting said ice layer by said flexible protection means elongating initially in response to vertical movement of said ice layer, said elongation resulting in a reduction in diameter of said flexible protection means thereby resulting in said diameter of said flexible protection means being less than the diameter of the hole in the ice which resulted when ice formed about said watertight compartment of said flexible protection means, resulting in separating of said suspension means from said ice layer.

11. In combination with a cathodic protection system for protecting a metallic water tank from corrosion, wherein at least one anode is provided for protecting said water tank from corrosion, the improvement of claim 10 wherein said suspension means apparatus further comprises:

a. first end fitting means in engaged relation within said flexible protection means at an upper end thereof, having a first receptical end receiving said first means suspending said suspension means apparatus, and having a second receptical end receiving a first end of said connecting means;

b. second end fitting means in engaged relation within said flexible protection means at a lower end thereof, having a first receptical end receiving said second means suspending said at least one anode or said reference cell from said suspension means and having a second receptical end receiving a second end of said connecting means;

c. first clamp means clamping a first end of said flexible protection means around said first end fitting means, thereby affecting a substantially water-tight seal therebetween;

d. second clamp means clamping a second end of said flexible protection means around said second end fitting means thereby affecting a substantially water-tight seal therebetween;

e. first sealing means affecting a substantially water-tight seal at the juncture of said first means suspending said suspension means apparatus from the inside roof of said water tank and said first end fitting means;

f. second sealing means affecting a substantially water-tight seal at the juncture of said second means suspending said at least one anode or said reference cell from said suspension means apparatus and said second end fitting means;

g. first compression screw means in threaded engagement with said first end fitting means securing said first end fitting means and said connecting means;

h. second compression screw means in threaded engagement with said second end fitting means securing said second end fitting means and said connecting means.

12. In combination with a cathodic protection system for protecting a metallic water tank from corrosion, wherein at least one anode is provided for protecting said water tank from corrosion, the improvement of claim 11 wherein said connecting means comprises:

a. steel wire means; and wherein said flexible protection means comprises:

b. an elastomeric tubing having a cross-section in the general form of two concentric circles and being of generally cylindrical form.

13. In combination with a cathodic protection system for protecting a metallic water tank from corrosion, wherein at least one anode is provided for protecting said water tank from corrosion, the improvement of claim 12 wherein said first end fitting means, said steel wire means, said second end fitting means, said first means suspending said suspension means apparatus and said second means suspending said at least one anode or said reference cell from said suspension means apparatus are all in electrically connected disposition and wherein said flexible protection means and said first and second sealing means are electrical insulators.

14. In combination with a cathodic protection system for protecting a metallic water tank from corrosion, wherein at least one anode is provided for protecting said water tank from corrosion, the improvement of claim 8 wherein said suspension means apparatus further comprises:

a. first end fitting means in engaged relation within said flexible protection means at an upper end thereof, having a first receptical end receiving said first means suspending said suspension means apparatus and having a second receptical end receiving a first end of said connecting means;

b. second end fitting means in engaged relation within said flexible protection means remote from a lower end thereof having a first receptical end receiving said second means suspending said at least one anode or said reference cell from said suspension means and having a second receptical end receiving a second end of said connecting means;

c. first clamp means clamping a first end of said flexible protection means around said first end fitting means thereby affecting a substantially watertight seal therebetween;

d. second clamp means clamping a portion of said flexible protection means around said second end fitting means thereby affecting a substantially watertight seal therebetween;

e. first sealing means affecting a substantially water-tight seal at the juncture of said first means suspending said suspension means from the inside roof of said water tank and said first end fitting means;

f. second sealing means affecting a substantially water-tight seal at the juncture of said second means suspending said at least one anode or said reference cell from said suspension means and said second end fitting means;

g. first compression screw means in threaded engagement with said first end fitting means securing said first end fitting means and said connecting means;

h. second compression screw means in threaded engagement with said second end fitting means securing said second end fitting means and said connecting means;

i. hole means disposed in and through the wall of said flexible protection means, at a position vertically lower than the location of said second clamp means and said second end fitting means;

wherein said flexible protection means extends below said second end fitting means and said second clamp means a distance in excess of the length of said reference cell, and wherein said flexible protection means has an inside cross-sectional area larger than said reference cell.

15. In combination with a cathodic protection system for protecting a metallic water tank from corrosion, wherein at least one anode is provided for protecting said water tank from corrosion, the improvement of claim 14 wherein said first end fitting means, said connecting means, said second end fitting means, said first means suspending said suspension means apparatus and said second means suspending said at least one anode or said reference cell from said suspension means apparatus are all in electrically connected disposition and wherein said flexible protection means is an electrical insulator.

16. The improved combination of claim 15 wherein said first means suspending said suspension means apparatus is of only such length that first end fitting means is above the maximum high water level in the tank when said improved combination is installed in the water tank.

17. The improved combination of claim 10 wherein said first means suspending said suspension means apparatus is of only such length that said first end fitting means is above the maximum high water level in the tank when said improved combination is installed in the water tank.

18. The improvement of claim 10 wherein said connecting means comprises:

a. steel wire means; and wherein said flexible protection means comprises:

b. an elastomeric tubing having a cross-sectional disposition of the general form of two concentric circles and being of generally hollow cylindrical form.

19. The improvement of claim 10 wherein said first means suspending said suspension means apparatus is of only such length that when the suspension means apparatus is installed in a watertank, a portion of said watertight compartment is above the maximum high level of water in the water tank and wherein said connecting means and said flexible protection means are each of sufficient length such that a portion of said watertight compartment is below the minimum low level of water in the water tank.

20. In combination with a cathodic protection system for protecting a metallic water tank subject to subfreezing environmental temperatures from corrosion, wherein at least one anode is provided for protecting said tank from corrosion, the improvement which comprises suspension means apparatus suspending either said at least one anode or a reference cell from the inside roof of the water tank, said suspension means apparatus comprising:

a. means suspending said suspension means apparatus from a suitable structure inside said water tank;
b. wire means connected to said at least one anode or said reference cell;
c. end fitting means having a first end receiving said means suspending said suspension means apparatus and having a second end receiving said wire means; and
d. flexible protection means surrounding and in direct engagement with said end fitting means and extending therebelow at least to the minimum low level of water in the watertank thereby surrounding at least a portion of the length of said wire means;

wherein said suspension means apparatus will self release from any ice layer which forms about said flexible protection means below said end fitting means upon a change in the water level supporting said ice layer by said flexible protection means elongating initially in response to vertical movement of said ice layer, said elongation resulting in a reduction in diameter of said flexible protection means thereby resulting in said diameter of said flexible protection means being less than the diameter of the hole in the ice which resulted when ice formed about said flexible protection means, resulting in separation of said suspension means from said ice layer.

21. The improved combination of claim 20 wherein said means suspending said suspension means is of only such length that said end fitting means is above the maximum high water level in the water tank when said improved combination is installed in the water tank.

* * * * *